US012805570B2

(12) United States Patent
Crowe

(10) Patent No.: US 12,805,570 B2
(45) Date of Patent: Nov. 24, 2026

(54) VAPORIZATION DEVICE USING FRUSTAL POROUS VAPORIZATION MEDIA

(71) Applicant: 9FD, LLC, Seattle, WA (US)

(72) Inventor: David Crowe, Lake Forest Park, WA (US)

(73) Assignee: 9FD, LLC, Seattle, WA (US)

( * ) Notice: Subject to any disclaimer, the term of this patent is extended or adjusted under 35 U.S.C. 154(b) by 307 days.

(21) Appl. No.: 18/018,555

(22) PCT Filed: Aug. 11, 2020

(86) PCT No.: PCT/US2020/045703

§ 371 (c)(1),
(2) Date: Jan. 28, 2023

(87) PCT Pub. No.: WO2021/262204

PCT Pub. Date: Dec. 30, 2021

(65) Prior Publication Data

US 2023/0292830 A1 Sep. 21, 2023

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/44*** | (2020.01) |
| ***A24F 40/485*** | (2020.01) |

(52) U.S. Cl.

CPC ..... *A24F 40/485* (2020.01); *A24F 40/10* (2020.01); *A24F 40/42* (2020.01); *A24F 40/44* (2020.01); *A24F 40/46* (2020.01)

(58) Field of Classification Search

CPC ..... A24F 40/10; A24F 40/46

See application file for complete search history.

(56) References Cited

U.S. PATENT DOCUMENTS

| | | | | |
|---|---|---|---|---|
| 12,185,760 | B2 * | 1/2025 | Potter | A24F 40/44 |
| 2014/0007863 | A1 | 1/2014 | Chen | |
| 2015/0181943 | A1 | 7/2015 | Li et al. | |

(Continued)

FOREIGN PATENT DOCUMENTS

| | | | |
|---|---|---|---|
| CN | 102970885 | A | 3/2013 |
| EP | 2888963 | A1 | 2/2019 |

(Continued)

OTHER PUBLICATIONS 20942060.3 , "EP Search Report", EP Application No. 20942060.3, Oct. 11, 2024, 9 pages.

(Continued)

*Primary Examiner* — Russell E Sparks

(74) *Attorney, Agent, or Firm* — Seed Intellectual Property Law Group LLP

(57) ABSTRACT

The present invention is directed towards a vaporization device that uses a vaporization media. The vaporization media used is an inherently non-porous solid having frustal voids that are specially formed to provide improved capillary action, and vaporization properties of high vaporization rate, tolerance to wide gamut of extract types and viscosities, dramatic reduction in non-extract media-emitted inhalable particulate or vapor, as well as collateral benefits such as fluid containment sealing, and manufacturability that are presently impossible with traditional vaporization media.

20 Claims, 4 Drawing Sheets

(56) References Cited

U.S. PATENT DOCUMENTS

| | | | | |
|---|---|---|---|---|
| 2017/0112193 | A1 | 4/2017 | Chen | |
| 2018/0279680 | A1* | 10/2018 | Rashid | A24F 40/46 |
| 2018/0343922 | A1* | 12/2018 | Stadler | A24F 40/485 |
| 2019/0350256 | A1 | 11/2019 | Hejazi | |
| 2020/0077703 | A1 | 3/2020 | Monsalud et al. | |
| 2020/0138115 | A1* | 5/2020 | Pettitt | A24F 40/46 |

FOREIGN PATENT DOCUMENTS

| | | | | |
|---|---|---|---|---|
| WO | 2019110669 | A1 | 6/2019 | |
| WO | 2019229197 | A1 | 12/2019 | |
| WO | 20190229197 | A1 | 12/2019 | |
| WO | 2020019030 | A1 | 1/2020 | |
| WO | WO-2020205561 | A1 * | 10/2020 | A24F 40/42 |

OTHER PUBLICATIONS

PCT/US2020/045703 , "International Search Report", PCT Application No. PCT/US2020/045703, Oct. 28, 2020, 2 pages.
"Foreign Office Action", CN Application No. 202080103282.1, Feb. 26, 2025, 19 pages.

* cited by examiner

VAPORIZATION DEVICE USING FRUSTAL POROUS VAPORIZATION MEDIA

CROSS-REFERENCE TO RELATED PATENT DOCUMENTS

This patent application claims the benefit of priority of Non-Provisional application Ser. No. 16/910,805 entitled "VAPORIZATION DEVICE USING FRUSTAL POROUS VAPORIZATION MEDIA," filed Jun. 24, 2020, and PCT application no. PCT/US2020/045703, filed 11 Aug. 2020, which are hereby incorporated herein by reference in their entirety.

FIELD OF THE DISCLOSURE

The present invention relates to devices and methods for vaporization of liquids and solids, and more particularly to a vaporizer and vaporization media having a plurality of frustal voids to provide improved capillary action during vaporization.

BACKGROUND

Tobacco and cannabis have long been used recreationally and medicinally, with smoking being the traditional and prevalent means for consumption. A variety of other means for consumption currently exist, while new consumption means are continually being developed.

Vaporization has gained prevalence as a means for consumption. Vaporization differs from smoking in that the cannabis or tobacco, extracts thereof, or cannabinoid concentrates are merely heated to the point of vaporization, rather than combusted. Vaporization ideally produces just inhalable vapor without smoke. Vaporization differs from smoking in that the extract is heated to a temperature high enough to volatilize the medicament into vapor but low enough to avoid combustion. Combustion products and byproducts, such as smoke and NO may be undesirable for consumption for a variety of reasons, including health effects and flavor preference. Vaporization optimally produces no smoke and the vapor will exhibit a complete absence of any associated burnt flavor.

Virtually all commercially available vaporizers operate by heating the extract with a miniature resistive heating element or coil to the point of vaporization, which is typically between 400-700° F. When the extract is directly exposed to surfaces that are hot enough to vaporize, it has a strong tendency to migrate away from the hot surface. Thus, the vaporization process is virtually always mediated by a media having wicking properties that will cause the extract to flow into and remain in proximity of a heating element. As the extract is converted to vapor in the media, the wicking properties cause the vaporized extract to be replaced with liquid extract.

Prior art media often used to prevent migration of the extract away from the heating element is a random matrix micro porous media, such as for example cotton, fiberglass, ceramic, or fritted glass. The wicking property, or sorptivity, of such media is a result of the shared property of microscopic porosity, which causes capillary action in the extract. Capillary action is the ability of a liquid to flow into narrow spaces as a result of surface tension and adhesive forces between the liquid and the container, and therefore requires small voids/pores within the media. In available media listed above, the small voids are inherent properties of the media materials, and void size and geometry is largely dictated by the specifics of the material choice. For example, porous materials such as kitchen sponges vary in the void size and geometry, but the essential geometric shapes and size ranges are limited by the material itself. Specialized void geometries and sizes are not possible with random matrix media.

Void size and geometry is also linked to specific capillary action behavior, such as flow rate and susceptibility to leaking. Because the pores/voids in the random matrix media are inherently random, thus specific capillary action can be difficult to control precisely. Furthermore, certain random pore geometries present in the random matrix media are undesirable for vaporization for a variety of reasons including reclaim accretion, loss or flaking of random matrix media and subsequent inhalation of resulted vapor, uncontrolled variation in batches and other quality control issues, as well as other various inherent limitations to the types and viscosities of the extract that will operate with a given type of media.

Additionally, the random matrix micro porous media generally has sorptivity that is approximately isotropic, and any fluid contained within the media is transported in all directions similarly. In most cases, the media is constantly supplied with the extract from a reservoir, and thus, in typical operation, the media in a typical vaporizer is fully saturated. Similar to a saturated sponge, fully saturated random matrix media is susceptible to extract seepage or leakage.

Furthermore, traditional random matrix media generally lacks strong material integrity and can easily be crushed or otherwise deformed and is therefore unsuitable for certain manufacturing methods and design elements that would rather benefit from a vaporizer media that has improved strength properties. Specifically, improved strength can allow for a seal to be placed into the element, whereas the seal would destroy traditional, more-brittle, random-matrix ceramic elements.

It is also desirable for a vaporizer or a vaporization process to produce pure vaporized extract that is free of non-extract, collateral inhalant material, which in most cases is present as collateral vaporized heating element or media material, or as shed particulate media, such as microscopic ceramic shards. There is significant demand for vaporizers that produce vapor that is free from such collateral inhalants.

SUMMARY

It is an object of the present invention to eliminate or at least ameliorate the disadvantages associated with use of random matrix micro porous media in vaporizers.

Another objective of the present invention is to provide a vaporization media that includes a plurality of voids with size and geometry that's better suited to the vaporization process.

Another objective of the present invention is to provide a vaporization media that is impermeable in selected directions while the capillary action in the extract is taking place to facilitate sealing and reducing or eliminating leakage of the extract during vaporization.

Another objective of the present invention is to provide a vaporizer media that has improved strength properties compared to traditional random matrix micro porous media (such as sponge, cotton, fiberglass, ceramic, or fritted glass).

The present invention is directed towards a vaporization device that uses a vaporization media. The vaporization media used is an inherently non-porous solid having a plurality of frustal voids that are specially formed to provide improved capillary action and vaporization properties of high vaporization rate, tolerance to wide gamut of extract types and viscosities, dramatic reduction in non-extract media-emitted inhalable particulate or vapor, as well as collateral benefits such as fluid containment sealing, and manufacturability that are presently impossible with current media.

Embodiments of the present invention disclose a vaporization media. The vaporization media includes a media wall having a liquid face that is adjacent to and in fluid communication with an extract reservoir, a vapor face that is adjacent to and in fluid communication with a vaporization chamber, and a thickness; and a pore that perforates the media wall, wherein the pore is approximately frustum-shaped, having an inlet located on the liquid face, an outlet located on the vapor face, and a height equal to the thickness of the media wall.

Embodiments of the present invention disclose an atomizer core for a vaporizer. The atomizer core includes a vaporization media having a media wall disposed between an extract reservoir and a vaporization chamber, wherein the media wall is perforated with a plurality of frustum-shaped pores, wherein the extract reservoir and the vaporization chamber being in fluid communication via the frustum-shaped pores, and a resistance heater disposed proximal to the media wall and adapted to heat the media wall for vaporizing extract content filled in the extract reservoir.

BRIEF DESCRIPTION OF DRAWINGS

The following detailed description, given by way of example and not intended to limit the invention solely thereto, will best be appreciated in conjunction with the accompanying drawings, in which.

DEFINITIONS

Figure 1:
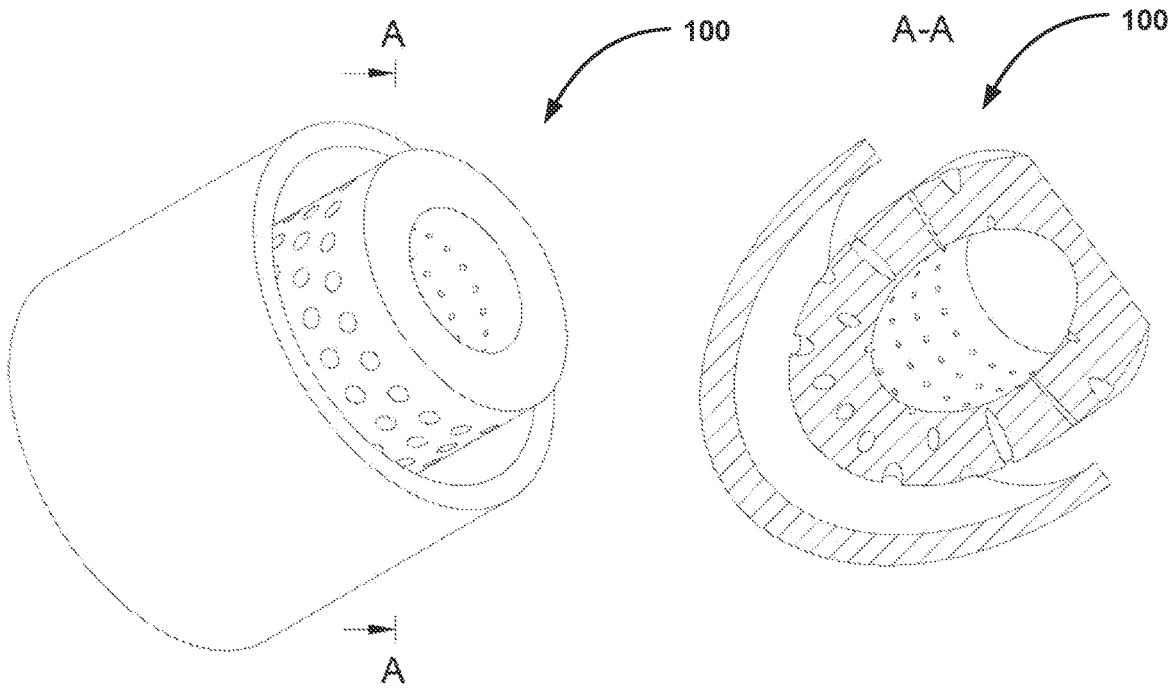
FIG. 1 shows an isometric perspective view and a corresponding section view taken along A-A of an atomizer core, according to an embodiment of the present invention.

Extract: Liquid vaporizable medicament, especially in relation to cannabis, tobacco, or synthetic variants thereof.

Frustal: of or related to frusta.

Vaporize: to produce vapor from a liquid or solid.

Vaporizer: Device used to vaporize.

DETAILED DESCRIPTION

In the summary above and in this detailed description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100, and includes both 25 and 100. Further in the context of the present disclosure, the terms "media,", "material," and so on are all interchangeably used. Further, the terms "vaporization media,", "vaporizer media," and so on are all interchangeably used in this disclosure.

The present invention discloses a device that vaporizes extract, commonly referred as vaporizer. The vaporizer consists of an atomizer. The atomizer further includes an atomizer core where the extract and vaporization media are disposed. During operation, the extract is heated to vaporize and the vaporized extract passes through the vaporization media to reach the vaporization chamber and then expelled through a mouthpiece of the atomizer for inhalation by a user of the vaporizer. The embodiments of the present invention related to the proposed vaporizer, atomizer assembly, and atomization media will now be discussed in detail with respect to FIGS. 1-4.

FIG. 1 shows an isometric perspective view and a corresponding section view taken along A-A of an atomizer core 100, according to an embodiment of the present invention.

Figure 2:
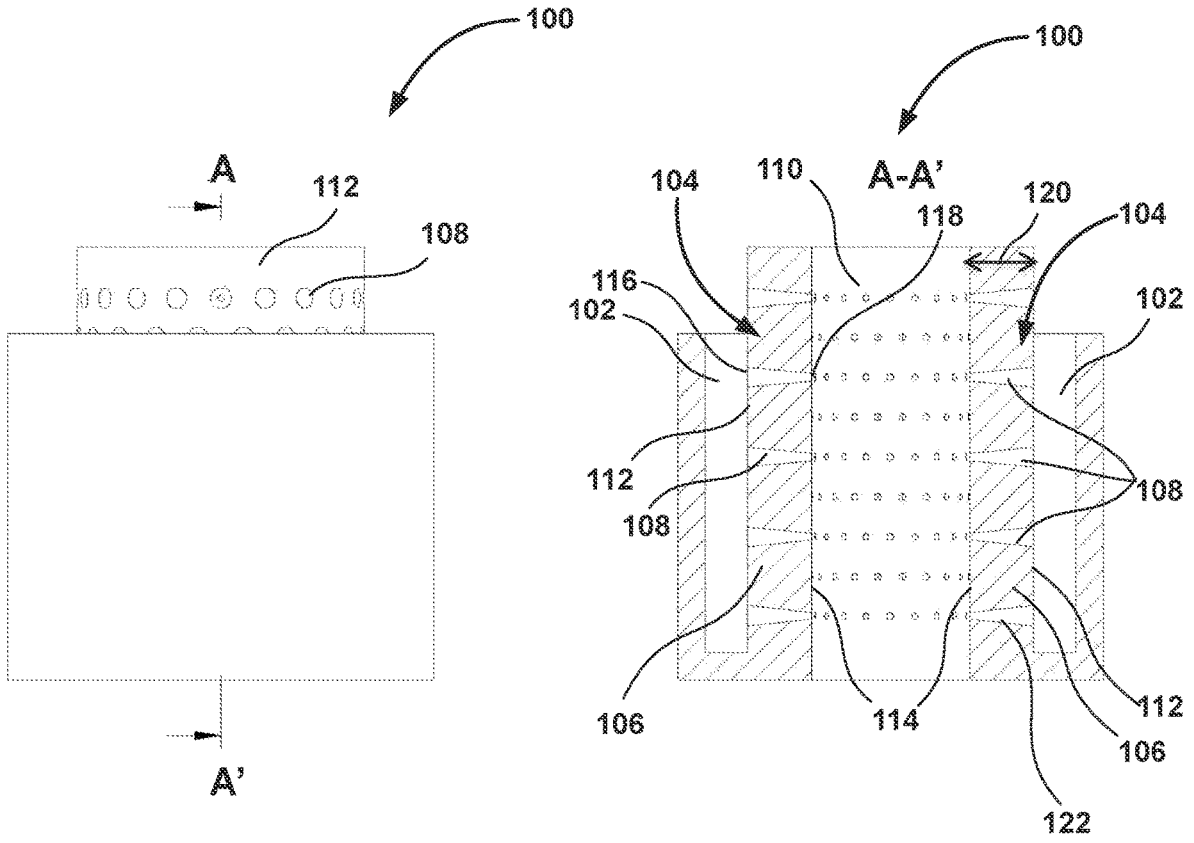
FIG. 2 shows a side view and a corresponding section view taken along A-A' of the atomizer core.

FIG. 2 shows a side view and a corresponding section view taken along A-A' of the atomizer core 100. As seen, the atomizer core 100 includes an extract reservoir 102 configured in fluid communication with a vaporization media 104. The extract reservoir 102 is configured for holding the extract which undergoes vaporization process. The vaporization media 104 comprises a media wall 106. The media wall 106 is perforated with a plurality of pores 108. In the preferred embodiment of the invention, the media wall 106 is a substantially nonporous material, such as quartz, metal, or certain nonporous ceramics. Porous material that is treated to reduce sorptivity, such as ceramic glaze or vapor deposition methods, may also be suitable. Porous material is less desirable due to factors such as reclaim accretion discussed supra. The pores 108 act as a medium for transportation of the extract from the extract reservoir 102 toward a vaporization chamber 110 of the atomizer core 100. The media wall 106 is solid and generally forms a barrier separating the extract reservoir 102 and the vaporization chamber 110, although the barrier is permeable in nature due to the presence of the pores 108 perforated into the media wall 106. Pores 108 excepted, the media wall 106 should be substantially nonporous. In other words, the material of the media wall 106 should have negligible sorptivity. The media wall 106 has a liquid face 112 adjacent to the extract reservoir 102 and a vapor face 114 adjacent to the vaporization chamber 110. The other face or faces of the frustrum are the conduit faces 122.

In the preferred embodiment, each of the pores 108 perforated into the media wall 106 are frustum-shaped or approximate frustum shaped voids in the media wall 106. In the preferred embodiment, the frustum is approximately the shape of a truncated cone, while in alternative embodiments, the frustum may be a pyramidal frustum or a prismatic solid, such as a cylinder or a prismatic polygon. In general, the pores are macroscopic in nature and detectable with the unaided human eye. In the embodiment, the conically shaped frustum pore 108 contains an inlet 116 present on the liquid face 112 of the media wall 106. The inlet 116 may have a diameter ranging from 0.3-0.7 mm. The conically shaped frustum pore further contains an outlet 118 present on the vapor face 114 of the media wall 106. The outlet 118 may have a diameter ranging from 0.1-0.5 mm. For the frustum of other geometrically shaped perforations/pores which have non-circular cross section as discussed above, the inlets may have an area of 0.07-0.38 $mm^2$ and outlets may have area of 0.008-0.2 $mm^2$. The pore's geometry has a significant effect on fluid flow through the pore. The fluid flow is higher through the pores if the pores have larger diameter and the media thickness 120 is smaller.

In operation, due to surface tension and the closely related phenomenon of capillary action, the liquid extract tends to flow into and completely fill the pores 108, while preventing liquid extract from flowing past the vapor face 114 and into the vaporization chamber 110, tending to keep intact any extract contained within the extract reservoir 102 and the vaporization media 104. Capillary action tends to increase as liquid viscosity decreases.

In the preferred embodiment, the vaporization media 104 is arranged cylindrically, such that the pores 108 are arranged in relation to a central axis. In alternative embodiments, the vaporization media 104 and pores 108 may be arranged in a flat, or planar configuration, or any other suitable geometry. The embodiment of the atomizer core 100 shown in FIGS. 1 and 2 has a uniform wall thickness 120 and a plurality of substantially identical pores 108. In alternative embodiments, the wall thickness 120 may be non-uniform, and the pore geometry may vary between pores. For example, some pores 108 may be shaped as conical frusta and some other pores 108 may have pyramidal frusta. Approximate frusta, having minor distortions to the general frustum shape may also be acceptable. For example, additive manufacture often induces slight distortions to the geometries, such as gentle curvature of the conical axes of the frusta. Such imperfections do not affect the function of the proposed vaporization media design. The key properties of the frusta are that the inlet 116 on the liquid face 112 of the media wall 106 is large enough to allow liquid extract to flow into the pore 108, while the outlet 118 on the vapor face 114 is small enough to cause surface tension to prevent liquid extract from flowing through, past the vapor face 114, and into the vaporization chamber 110 and resulting in seepage or leakage. Finally, the outlet 118 must be large enough to freely emit vaporized extract into the vaporization chamber 110.

Figure 3:
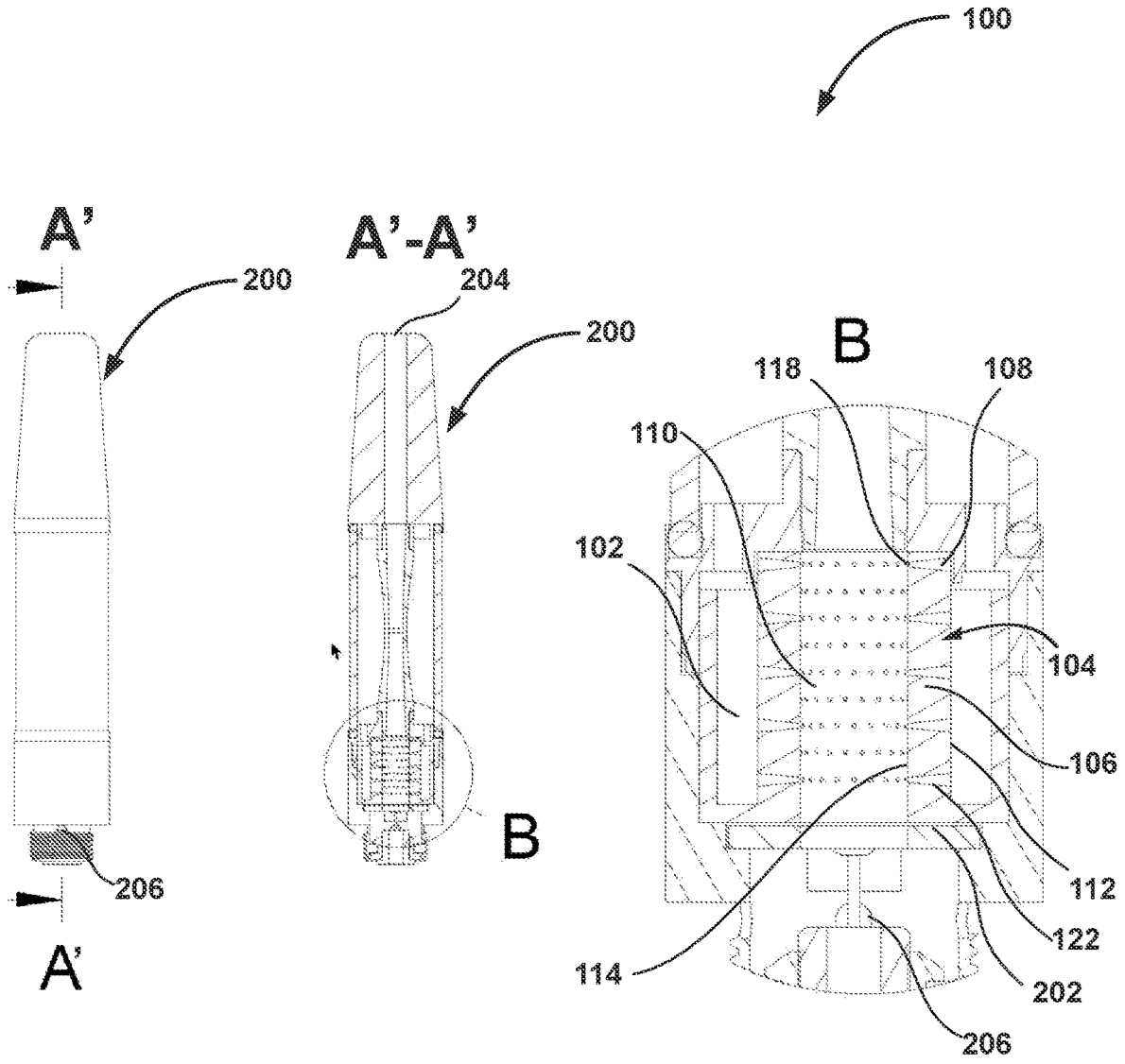
FIG. 3 shows a side view, a section view taken along A'-A', and a detailed enlarged section view B taken from the section view of an atomizer assembly of a vaporizer, according to an embodiment of the present invention.

FIG. 3 shows a side view, a section view taken along A'-A', and a detailed enlarged section view B taken from the section view of an atomizer assembly of a vaporizer, according to an embodiment of the present invention. The detailed enlarged section view B represents the atomizer core 100 discussed in FIG. 2 above. As seen, the atomizer assembly 200, when combined with a battery (not seen), forms a vaporizer (not seen). The atomizer assembly 200 will function to vaporize the extract when an electrical current is supplied to an ohmic resistance heater 202. The function of the heater 202 is to heat the vaporization media 104 to a temperature above the vaporization temperature of the extract, approximately 400 F, preferably in between 400-700° F. In the embodiment, heat generated by the heater 202 is transferred into the vaporization media 104 via conduction. Due to the relatively small scale of the device, heat energy is efficiently transferred throughout the volume of the vaporization media 104 and transferred preferentially to the extract contained within the frustal pores 108. In the preferred embodiment, the conical pore geometry preferentially heats extract disposed toward the outlet 118, which may be desirable. When sufficient heat energy is transferred to the extract present within the pores 108, the extract will begin to vaporize and to be expelled through the outlet 118 on the vapor face 114 and into the vaporization chamber 110. The vaporization chamber 110 serves to contain and or collect vapor prior to consumption by a user. In an embodiment, the vaporization chamber 110 is in fluid communication with a mouthpiece 204 and a vent 206. Application of negative pressure to the mouthpiece 204 will transport vaporized extract to the environment for consumption. As vaporized extract is expelled through the outlet 118, capillary forces cause the liquid extract to continuously flow into the pores 108 and replace vaporized extract.

The pores 108 are specially adapted to conduct the transport of the extract to the vapor face 114. Conduit faces 122 of the pores 108 are substantially nonporous. Furthermore, the preferred materials for the vaporization media 104 have dramatically improved structural properties over traditional vaporization media of prior art, such as porous ceramic or fritted glass. Therefore, the atomizer core 100 is able to be a stressed component within the atomizer assembly 200, and furthermore is suitable for manufacturing processes such as press-fitting due to the improved mechanical properties.

The heater 202 is shown as a washer-shaped (rectangular toroid) element, formed of a metallic resistive element that is encapsulated in an electrically insulative material, such as ceramic. In alternative embodiments, the heater 202 may be any resistive heating element capable of heating the atomizer core 100 to above the extract vaporization temperature. In an embodiment, the heater 202 may be located within the vaporization chamber 110 and transfer heat to the atomizer core 100 via radiation. In alternative embodiments, the heater 202 may be a resistor that is embedded within the atomizer core 100 itself. In the preferred embodiment, the heater 202 has a resistance of less than 1 Ohm. A heater 202 is preferably located proximal to the atomizer core 100 if the heater 202 is capable of heating the atomizer core 100 to a temperature higher than the vaporization temperature of extract.

In the preferred embodiment, collateral vaporization is minimized by encapsulating the resistive heating element 202 in a material such as ceramic. Similarly, materials and coatings that resist collateral vaporization, such as nonporous ceramic, are preferable in order to mitigate or eliminate off-gassing during operation.

Figure 4:
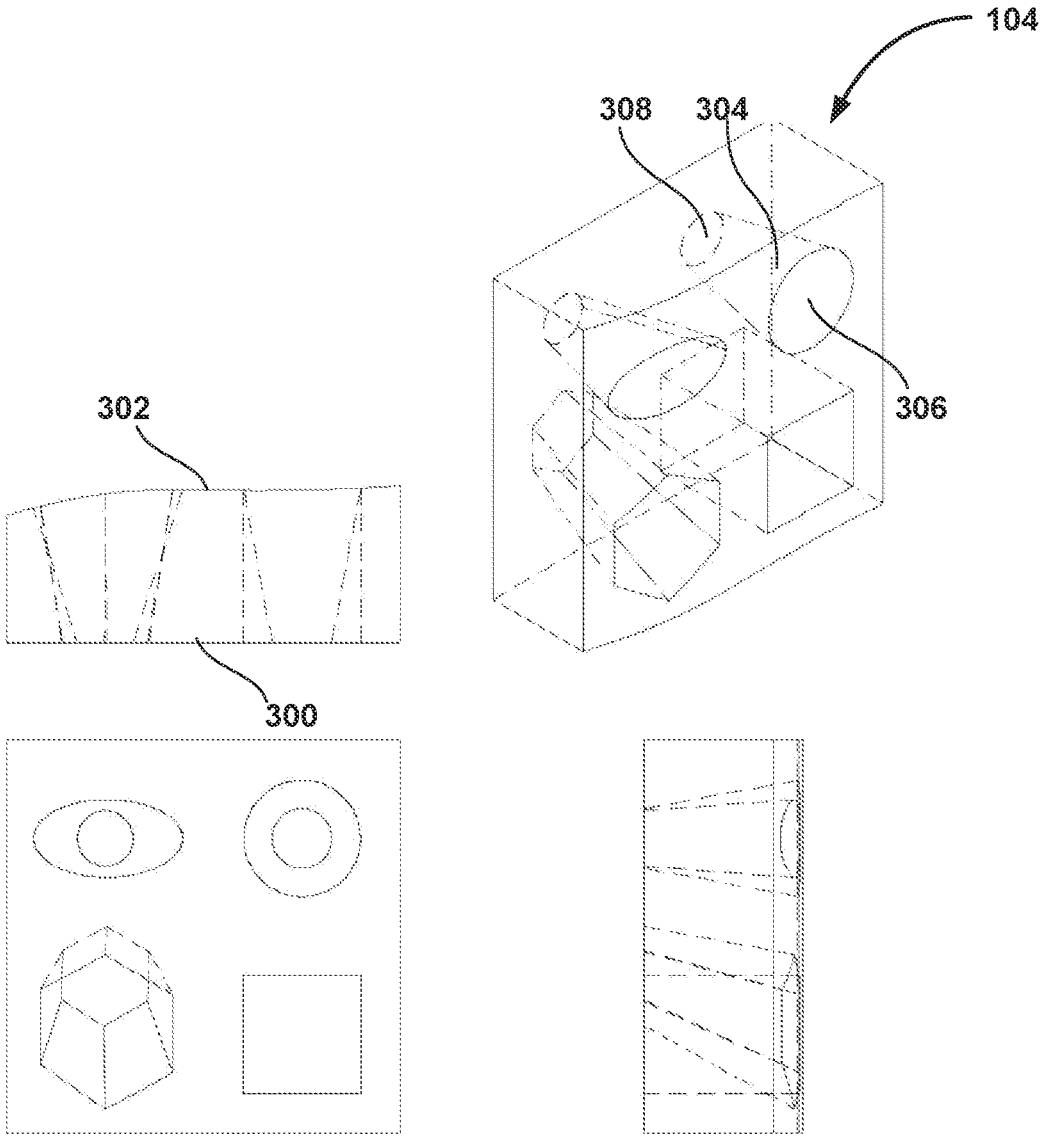
FIG. 4 shows a front view, two side views, and an isometric view of approximate frustal pores present in the proposed vaporization media.

FIG. 4 shows a front view, two side views, and an isometric view of approximate frustal pores present in the proposed vaporization media 104. The frustal pores 108 need not be geometrically exact frusta. For example, geometrically exact frusta would have planar faces 300, while an approximate frusta may have a face that includes slight curvature such as curvature 302. Similarly, geometrically exact frusta have parallel faces that are geometrically similar, while an approximate frusta may have faces that are not either geometrically similar or exactly parallel. For example, approximate frustum 304 deviates from an exact frustum because of following reasons: 1) the face 306 of the approximate frustum 304 is not a plane, but rather it is a slight curve due to the curved face 302, 2) the face 306 of the approximate frustum 304 is only approximately parallel to the face 308 rather than exactly parallel, and 3) the faces 306 and 308 are not geometrically similar, though the shapes are approximately similar. Frustal pores 108 will have a pore height equal to the media thickness 120.

In the preferred embodiment, the atomizer core 100 is comprised of non-porous ceramic that is fabricated via additive manufacture. A non-exhaustive list of various factors that affect material choice for the nonporous solid media wall 106 would include thermal conductivity, melting temperature, intrinsic material porosity, suitability for food-grade usage and nontoxicity, additive manufacturability, subtractive manufacturability, material strength, material toughness, coatability, and price.

Additive manufacture is the preferred method of manufacture, and suitable materials include ceramic, iron, titanium, and quartz. Subtractive manufacturing methods including laser boring, stylus EDM, and traditional machining may be viable, and suitable materials include ceramic, glass, quartz, and metal. Materials that exhibit porosity may be used if it is possible to treat porous surfaces to cause them be nonporous, such as applying ceramic coatings or other similar surface treatments. Any random or anomalous porosity will tend to introduce the undesirable properties present in the prior art. Therefore, some low degree of random or anomalous porosity can be tolerated, but is not preferable.

Further, in the preferred embodiment, the atomizer core 100 is a single integral part. In alternative embodiments, the atomizer core 100 may be comprised of a plurality of discrete parts. Similarly, in the preferred embodiment, the elongate frustal pores 108 are voids formed within a larger monolith. In alternative embodiments, the frustal voids may reside between discrete mating parts.

While preferred and alternate embodiments have been illustrated and described, as noted above, many changes can be made without departing from the spirit and scope of this invention. Accordingly, the scope of the present invention is not limited by the disclosure of these preferred and alternate embodiments. Instead, the scope of the present invention is to be determined entirely by reference to the claims. Insofar as the description above and the accompanying drawings disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶ 6. In particular, the use of "step of" in the claims herein is not intended to invoke the provisions of U.S.C. § 112 ¶ 6.

What is claimed is:

1. A vaporization media comprising a media wall including:

a liquid face that is adjacent to and in fluid communication with an extract reservoir;

a vapor face that is adjacent to and in fluid communication with a vaporization chamber, the media wall arranged cylindrically around the vapor face; and pores that perforate the media wall and are arranged in relation to a central axis of the media wall, the pores being substantially identical, approximately frustum-shaped, and having:

inlets located on the liquid face, the inlets having a diameter ranging from 0.3-0.7 mm;

outlets located on the vapor face, the outlets being smaller than the inlets, the outlets having a diameter ranging from 0.1-0.5 mm and configured to prevent liquid from flowing into the vaporization chamber while allowing vapor into the vaporization chamber; and surfaces of the pores that are made of ceramic and are substantially nonporous.

2. The vaporization media of claim 1, wherein the pores are pyramidal shaped.

3. The vaporization media of claim 1, wherein the pores are prismatic shaped.

4. The vaporization media of claim 1, wherein the inlets have an area of 0.07-0.38 $mm^2$ and the outlets have an area of 0.008-0.2 $mm^2$.

5. The vaporization media of claim 1, wherein the media wall forms a cylinder, and the pores are arranged relative to a surface of the cylinder.

6. The vaporization media of claim 1, wherein the media wall is a substantially nonporous material.

7. The vaporization media of claim 1, wherein the media wall is a ceramic material.

8. The vaporization media of claim 1, wherein a thickness of the media wall is uniform.

9. The vaporization media of claim 1, wherein the inlets allow liquid extract to flow into the pores, while the outlets cause surface tension to prevent liquid extract from flowing past the vapor face and into the vaporization chamber of an atomizer core.

10. The vaporization media of claim 9, wherein the liquid extract flows into the pores through the inlets due to capillary action.

11. The vaporization media of claim 1, wherein the media wall is a single part.

12. A device comprising:

a liquid face that is adjacent to and in fluid communication with an extract reservoir;

a vapor face that is adjacent to and in fluid communication with a vaporization chamber; and a pore that perforates a media wall of the device, the media wall being arranged cylindrically around the vapor face, and the pore being approximately frustum-shaped, arranged with other substantially similar pores in relation to a central axis of the media wall, and having:

an inlet having an area of 0.07-0.38 $mm^2$ located on the liquid face;

an outlet having an area of 0.008-0.2 $mm^2$ located on the vapor face, the outlet being smaller than the inlet and configured to prevent liquid from flowing into the vaporization chamber while allowing vapor into the vaporization chamber; and a surface of the pore that is made of ceramic and is substantially nonporous.

13. The device of claim 12, wherein the pore is pyramidal shaped.

14. The device of claim 12, wherein the pore is prismatic shaped.

15. The device of claim 12, wherein the pore is a truncated cone having the inlet with a diameter ranging from 0.3-0.7 mm, and the outlet with a diameter ranging from 0.1-0.5 mm.

16. The device of claim 12, wherein the media wall forms a cylinder, and the pore is arranged relative to a surface of the cylinder.

17. The device of claim 12, wherein the media wall is a substantially nonporous material.

18. The device of claim 12, wherein the media wall is a glazed ceramic material.

19. The device of claim 12, wherein the media wall is a single part.

20. A media for vaporization of liquids or solids, comprising:

a media wall comprising:

a liquid face that is adjacent to and in fluid communication with an extract reservoir;

a vapor face that is adjacent to and in fluid communication with a vaporization chamber, the media arranged cylindrically around the vapor face; and a pore that perforates the media wall and arranged with substantially identical pores in relation to a central axis of the media wall, the pore being approximately frustum-shaped and having:

an inlet located on the liquid face, the inlet having a diameter ranging from 0.3-0.7 mm;

an outlet located on the vapor face, the outlet being smaller than the inlet, the outlet having a diameter ranging from 0.1-0.5 mm and configured to prevent liquid from flowing into the vaporization chamber while allowing vapor into the vaporization chamber; and a surface of the pore that is made of ceramic and is substantially nonporous.

* * * * *